United States Patent [19]

Krishnakumar et al.

[11] Patent Number: 4,791,688

[45] Date of Patent: Dec. 20, 1988

[54] JET PUMP MACERATOR PUMP SEWAGE HANDLING SYSTEM

[75] Inventors: C. K. Krishnakumar, Lombard; P. A. Saigh, Morton Grove, both of Ill.

[73] Assignee: Chamberlain Manufacturing Corporation, Elmhurst, Ill.

[21] Appl. No.: 83,606

[22] Filed: Aug. 7, 1987

Related U.S. Application Data

[63] Continuation of Ser. No. 808,156, Dec. 12, 1985, abandoned.

[51] Int. Cl.[4] ..... E03D 9/10

[52] U.S. Cl. ..... 4/319; 4/316; 4/321; 417/92; 417/80

[58] Field of Search ..... 4/316, 319, 320, 321, 4/340, 342, 300, 420, 431, 432, 433, 434, 435; 210/195.3, 416.1, 221.2, 173; 137/240; 417/92, 148, 79, 80

[56] References Cited

U.S. PATENT DOCUMENTS

| | | | |
|---|---|---|---|
| 1,037,586 | 9/1912 | Biraner | 417/92 |
| 1,613,849 | 1/1927 | Riegel | 4/323 |
| 1,681,280 | 8/1928 | Bruckner | 417/92 |
| 1,732,775 | 10/1929 | Shaver | 4/319 |
| 1,778,520 | 10/1930 | Curtiss | 4/431 |
| 2,677,389 | 5/1954 | Jisha et al. | 417/80 |
| 3,275,550 | 9/1966 | Daubenspeck | 4/319 |
| 3,835,478 | 9/1974 | Molus | 4/DIG. 3 |
| 3,922,730 | 12/1975 | Kemper | 4/316 |
| 3,922,976 | 12/1975 | Davis et al. | 4/319 |
| 3,958,279 | 5/1976 | Bogusz | 4/317 |
| 4,012,322 | 3/1977 | Saigh et al. | 210/86 |
| 4,115,876 | 9/1978 | Cole, Jr. et al. | 4/317 |
| 4,156,297 | 5/1979 | Pilolla | 210/143 |
| 4,199,828 | 4/1980 | Hellers | 4/321 |
| 4,214,324 | 7/1980 | Kemper et al. | 4/300 |
| 4,232,409 | 11/1980 | Van Pham | 4/431 |
| 4,306,321 | 12/1981 | Norlin | 4/321 |

*Primary Examiner*—Henry J. Recla
*Assistant Examiner*—Linda J. Sholl
*Attorney, Agent, or Firm*—Hill, Van Santen, Steadman & Simpson

[57] ABSTRACT

A jet pump macerator pump sewage handling system which provides a unique waste control system for use in mobile units such as passenger trains and ships in which multiple toilets are connected to a transfer manifold pipe which communicates with a non-clogging jet pump which is formed with a venturi and through which liquid material is driven by a macerator pump. Waste material from the toilets is drawn by the jet pump through the transfer manifold pipe and discharged into the retention tank. The macerator pump withdraws material from the retention tank, grinds it and discharges it back into the retention tank. The macerator pump has a self-cleaning feature in that it reverses and cleans itself whenever a loss in discharge pressure due to excessive solids loading is sensed. The transfer manifold pipe is virtually free from clogging due to the action of an air induction valve which keeps waste material in the manifold pipe moving without allowing it to accumulate.

6 Claims, 3 Drawing Sheets

JET PUMP MACERATOR PUMP SEWAGE HANDLING SYSTEM

This is a continuation of application Ser. No. 808,156, filed Dec. 12, 1985, now abandoned.

BACKGROUND OF THE INVENTION

1. Field of the Invention

The invention relates in general to waste control systems for use in mobile units such as passenger trains and ships and in particular to a novel jet pump macerator pump sewage handling system.

2. Description of the Prior Art

In prior art waste control systems for use in mobile units such as passenger trains and ships; toilets, manifold pipes and pumps were very susceptible to becoming clogged. When this happened, it was necessary to manually unclog the system, either by applying pressure to the clogged material to remove it or, alternately, to use a clean out trap for removing the blockage. Further, in multiple toilet systems, only one toilet could be flushed at one time requiring the others to be locked out during flushing of the first toilet.

SUMMARY OF THE INVENTION

The present invention comprises a novel jet pump macerator pump sewage handling system wherein a plurality of toilets are connected to a transfer manifold pipe which then feeds to a retention tank through a non-clogging jet pump. A macerator pump removes sewage materials from the bottom of the retention tank and macerates such material and then drives it through the non-clogging jet pump to siphon the transfer manifold pipe materials into the retention tank.

The system handles sewage from single or multiple toilets and it is a compact and practically maintenance free system. The pressure energy of the stream entering the inlet of the jet pump is converted into Kinetic energy of a high velocity jet in the suction zone of the jet pump causing a corresponding drop in pressure. The jet pump is designed so as to provide the desired vacuum which might for example be one-half atmosphere in the suction zone at the volume flow rate generated by the macerator pump.

The non-clogging jet pump has no moving parts and generates vacuum by the efficient conversion of the pressure energy of the liquid stream into its kinetic energy. The non-clogging jet pump provides the required vacuum in its suction zone at the normal discharge rate of the macerator pump and the diameter of the least section of the jet pump nozzle is selected so that it is larger than that of the discharge nozzle of the macerator pump. This ensures clog free operation of the jet pump since materials discharged by the macerator pump will freely pass through the jet pump nozzle.

The bowl evacuation valves in the sewage handling system may be actuated with air or water pressure for fast response and smooth operation rather than by slower acting electrically operated valves. According to the present invention, the system can also operate in a self-contained mode in which it generates its own supply of compressed air for valve actuation. A hydraulic air compressor according to the invention can be provided at the discharge side of the macerator pump. In such system when a flush cycle is initiated and the macerator pump is turned on water will rush into the air/water chamber compressing the air trapped in it. A first solenoid valve which opens when the pump starts, allows pressurized air from the top portion of the air chamber to fill the pip supplying compressed air to the evacuation valves. The volume of the air/water chamber is such that a large enough number of flush cycles can be performed without emptying all of the air from the chamber before the macerator pump shuts off. When the pump turns off, a solenoid valve and a one-way valve close trapping compressed air between them and the evacuation valves. Water in the air/water chamber drains back into the pump and the holding tank as fresh air is inducted into the chamber through an air induction valve. A float valve prevents water from getting into the solenoid valve in the event the air/water chamber loses all of its air due to leaks. A large rubber ball float serves to dampen pressure oscillations and to prevent water splashes from getting past the float valve.

The hydraulic air compressor is rugged and reliable and has no parts which are likely to clog such as strainers or components that are likely to stick such as pistons at the air/water interface in the chamber.

It is an object of the present invention to provide an improved jet pump macerator pump sewage handling system. The novel features of the present invention are listed below.

1. Elimination of the need to preserve vacuum during the non-flush periods: Vacuum in the system is developed only when a toilet is flushed. Unlike in systems that hold vacuum during non-flush periods, air leaks do not cause the pump-motor unit to start during non-flush periods. This leads to longer life of the pump-motor unit.

2. Self-cleaning macerator pump: If the jet-pump suction drops during flushing due to loss of pump performance caused by excessive solids loading in its casing, the macerator pump automatically goes through a short reversing cycle to clean itself. The pump performance is brought back and normal jet pump suction is resumed for the next flushing cycle.

3. Clog-free manifold pipe: The action of an air induction valve located at the far end of the manifold pipe, keeps it virtually free from clogging.

4. Ability of the system to handle more than one toilet at a time: When one toilet is flushing, it is not necessary to lock out the others.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
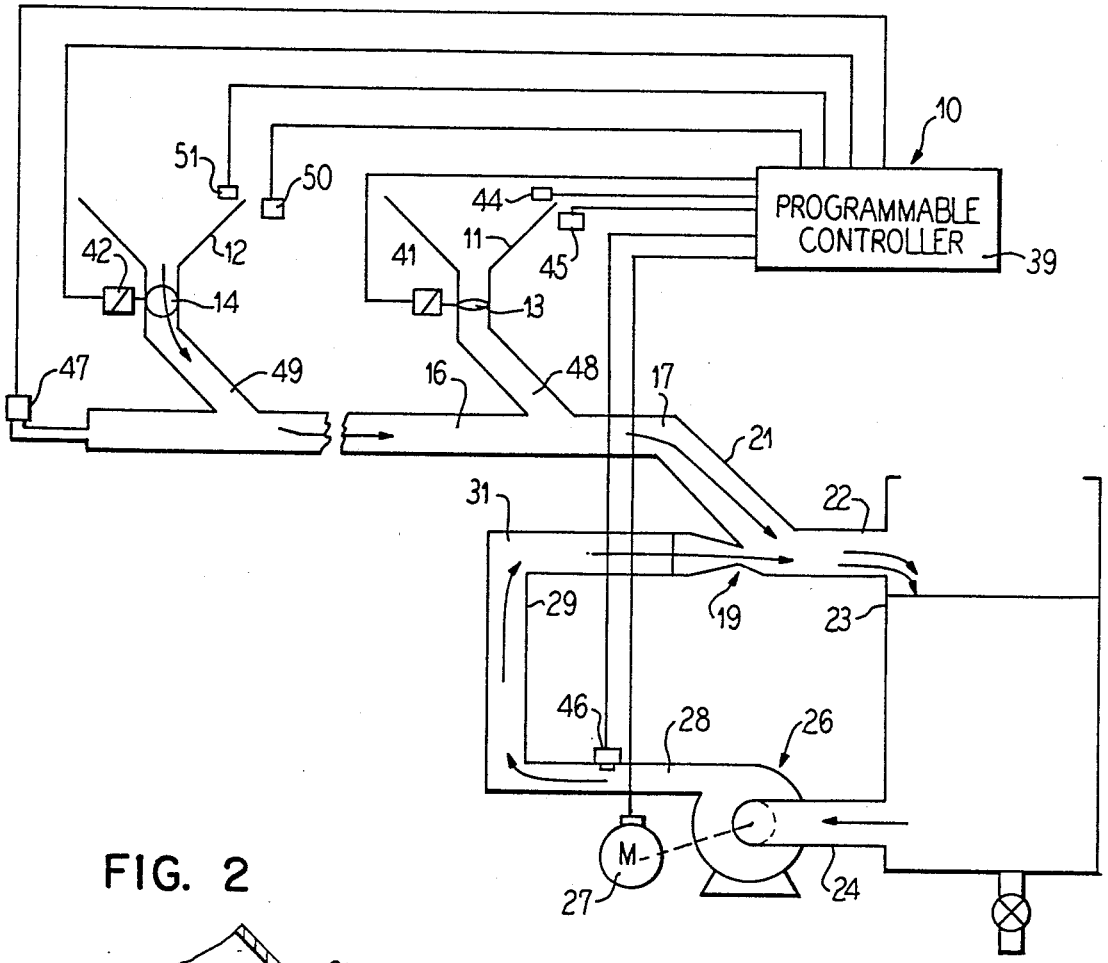
FIG. 1 is a schematic sectional view of the invention illustrating the macerator pump supplying fluid through the jet pump.
Figure 2:
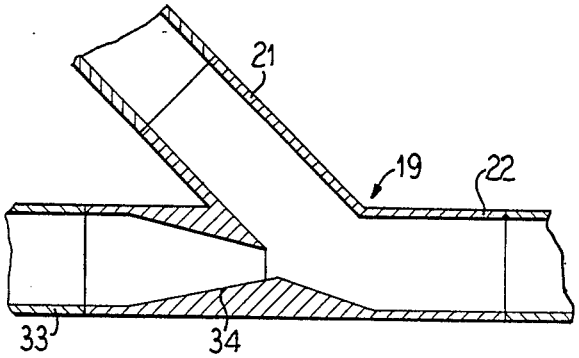
FIG. 2 is a sectional view through the jet pump.

FIGS. 1 and 2 illustrate the jet pump macerator pump sewage handling system of the invention which might, for example, be utilized on a passenger train or a ship and which comprises one or more toilets such as the toilets 11 and 12 which are connected to discharge through bowl evacuation valves 13 and 14 which are controlled by controls 41 and 42 into pipes 48 and 49 that are connected to a transfer manifold pipe 16. The transfer manifold pipe 16 has a downwardly extending portion 17 which extends into the non-clogging jet pump 19 which has an outlet pipe 22 that is connected to a retention tank 23. An outlet pipe 24 is connected to the retention tank 23 and supplies an input to a macerator pump 26 which receives material from the retention tank and macerates it and supplies it to macerator pump outlet pipe 28. The macerator outlet pipe 28 is connected to a pipe 29 which connects to a pipe 31. The other end of pipe 31 is connected to the inlet of the non-clogging jet pump 19. The non-clogging jet pump 19 has a venturi reduced cross-sectional portion 34 as illustrated in sectional view FIG. 2 such that when fluid is passing through the non-clogging jet pump 19 from pipe 33 to the outlet 22 suction is applied to the inlet pipe 21.

A motor 27 drives the macerator pump 26 and has a control 25 which is connected to a control 39. The controls 41, 42, 44, 47 and 51 are connected to the control 39. A pressure sensor 46 is mounted to sense the discharge pressure of the pump and supplies an input to control 39.

A flush control 45 is mounted adjacent toilet 11 and a flush control 50 is mounted adjacent toilet 12. The flush controls 45 and 50 are connected to the control 39 as illustrated.

In operation, if the toilet 12 is flushed by actuating flush control 50, control 39 causes the macerator pump to start. Within a short time (approximately 3 seconds), vacuum is built in the transfer manifold. The programmable controller then opens the toilet flush valve through control 51 following which it opens the evacuation valve 14 through control 42. Waste material is drawn from the toilet bowl through the transfer manifold 16 in to the retention tank 23 by the action of the jet pump. The macerator pump draws the waste from the retention tank, macerates it and drives it through pipes 28, 29 and 31 and through the jet pump back into the retention tank. After a few seconds of evacuation, the programmable controller causes the evacuation valve to close through control 42. After a prescribed time (such as 1 second), the flush valve is closed through control 51. The solenoid valve 47 is now opened by the programmable controller letting high speed air to be inducted through the transfer manifold. The air stream forces the waste in the manifold into the retention tank and keeps the manifold dry and clean. The macerator pump continues to run for several minutes causing air to be inducted through the transfer manifold and also macerating wastes drawn from the retention tank through pipe 24. After a prescribed time, the programmable controller shuts off the macerator pump through control 25 and also causes Solenoid valve 47 to close.

If the same toilet is flushed again or another toilet is flushed before the macerator pump shuts-off, the following sequence of operations will be initiated by the programmable controller 39. First the pump timer will be reset to zero, solenoid valve 47 will be closed, the water flush valve will be opened, and the toilet evacuation valve will be opened. As in the previous cycle, after the elapse of the prescribed evacuation period, the evacuation valve will close, the water flush valve will shut-off and the solenoid valve 47 will open inducting air through the manifold. Programmable Controller 39 will turn off the pump and close valve 47 after the set pump cycle time.

The jet pump which has no moving parts generates vacuum by efficient conversion of the pressure energy of the liquid stream into its kinetic energy. It is designed to provide the required vacuum of, for example, one-half atmosphere in the suction zone at the normal discharge rate of the macerator pump. Table 1 illustrates the normal operating variables of the system.

TABLE 1

| Macerator Pump Discharge Rate | Pressure at Inlet of Jet Pump | Vacuum in the Manifold Pipe | Velocity of Flow in the Jet Pump Nozzle |
|---|---|---|---|
| 45 gpm | 25 psi | 7 psi | 60 fps |

The vacuum created in the suction zone 34 draws the waste material from the transfer manifold 16 into the jet pump where it is discharged through pipe 22 into the retention tank 23. The diameter of the narrowest section of the jet pump nozzle is selected to be larger than that of the discharge nozzle of the macerator pump casing so as to ensure clog-free operation of the jet pump since materials discharged by the macerator pump will freely pass through the jet pump nozzle.

The macerator 26 and motor 27 may be a heavy duty two horsepower unit which readily grinds toilet waste including sanitary napkins and a variety of other readily reducable waste objects which might be accidentally dropped into a toilet bowl. The macerator pump is mounted on the upstream side of the jet pump so that only ground material flows through the jet pump. A short neck in the discharge nozzle of the macerator pump restricts the maximum size of the solid particles which reach the jet pump nozzle.

Figure 3:
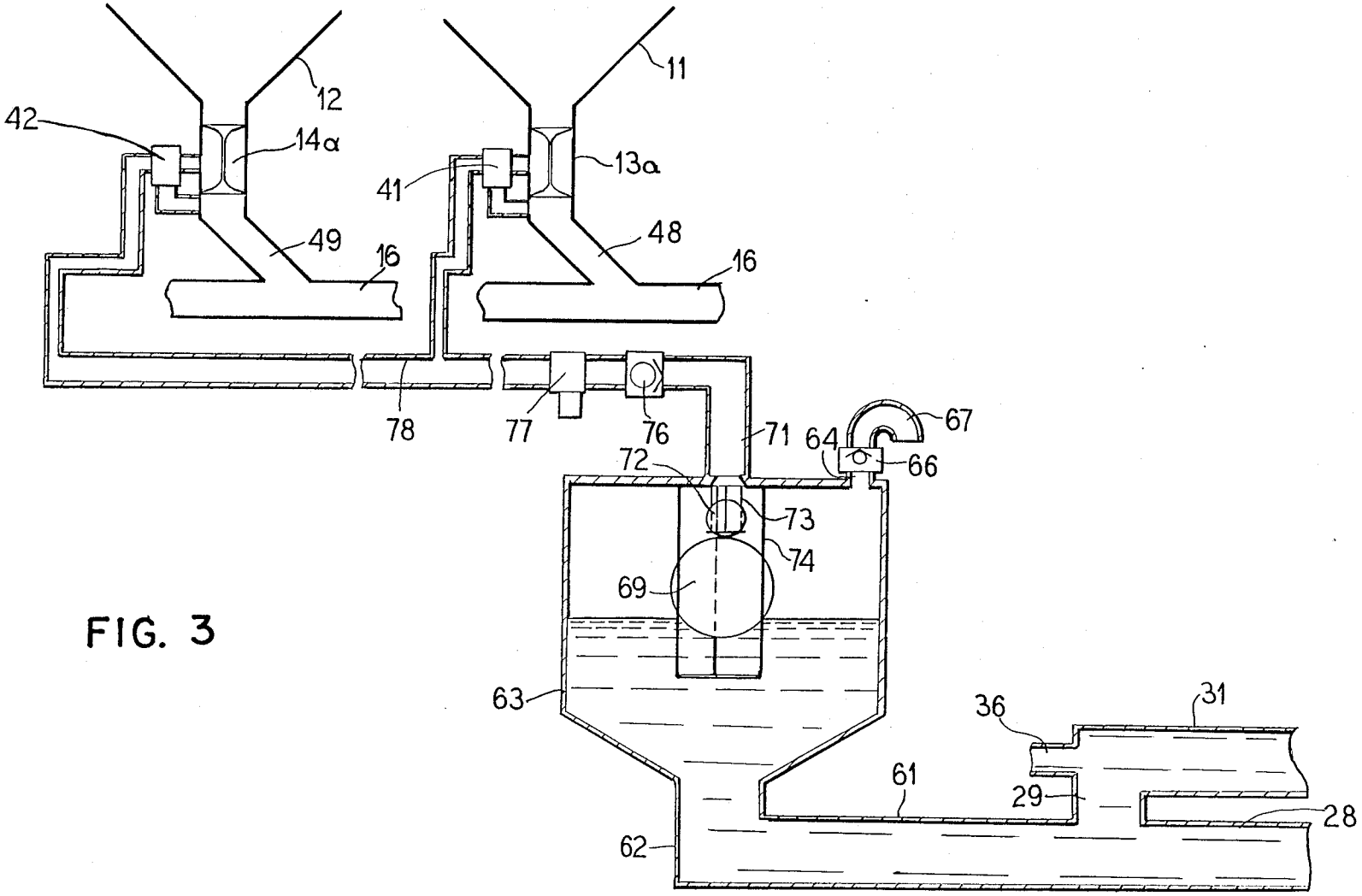
FIG. 3 is a schematic view of the hydraulic air compressor of the invention
Figure 4:
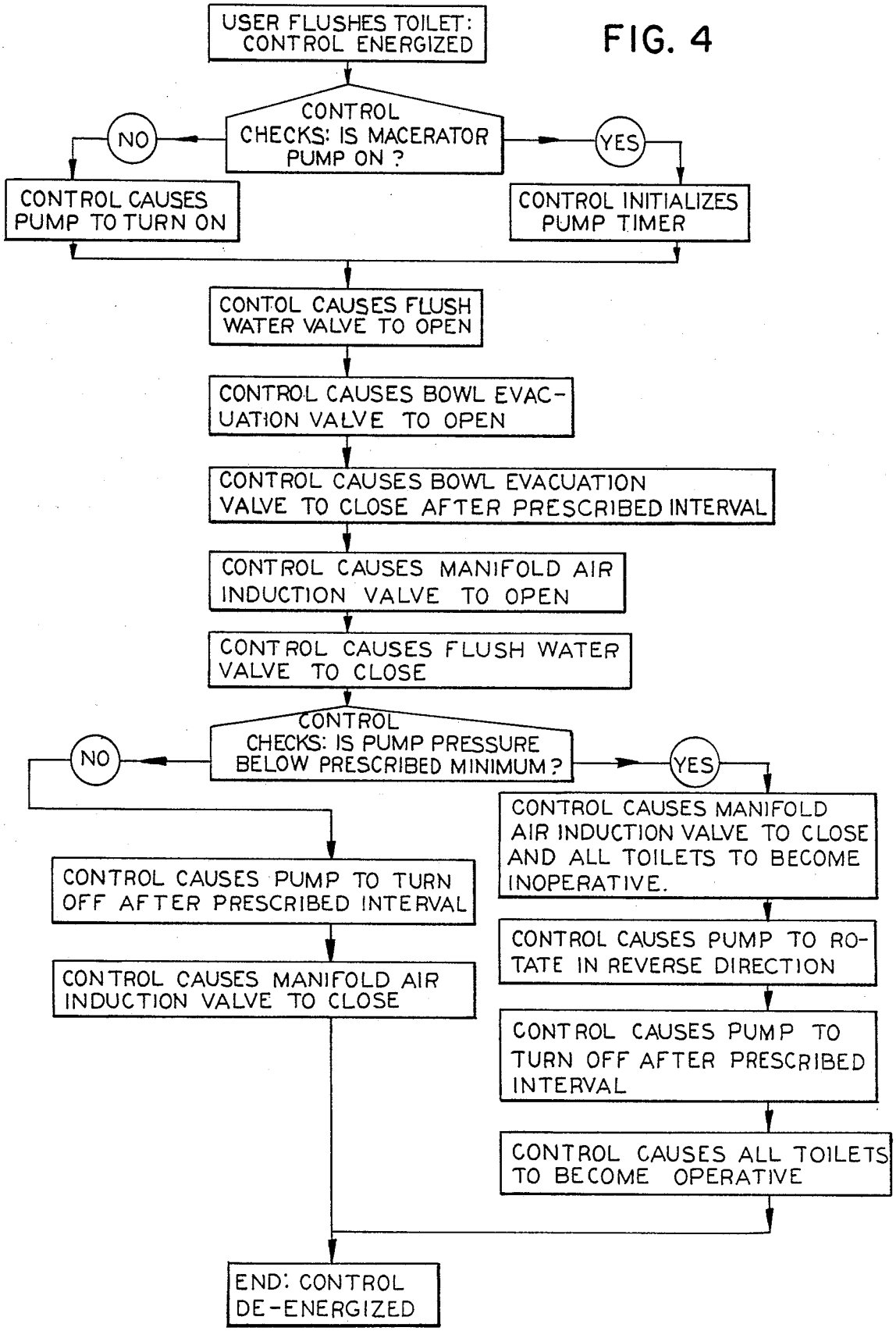
FIG. 4 is a Functional Flow Chart.

The bowl evacuation valves 13 and 14 may be actuated with air or water pressure for faster response and smoother operation instead of slower responding electrically operated valves. The system can be made self-contained by causing it to generate its own supply of compressed air for valve actuation. This can be achieved by incorporating the hydraulic air compressor 63 illustrated in FIG. 3 at the discharge side of the macerator pump 26.

When a flush cycle is initiated and the macerator pump 26 is turned on, water rushes into the air water chamber **63*a* the compressor 63 through pipes 61 and 62 which are connected to the output pipe 28 of the macerator pump and this causes air to be compressed in the air water chamber of the hydraulic air compressor 63. A solenoid valve 77 opens when the macerator pump 26 starts and lets pressurized air from the top portion of the air water chamber 63*a* flow to the pipe 78 as long as the air pressure upstream of the one-way valve 76 is sufficient to keep it open. The volume of the air/water chamber 63*a* is such that a large enough number of flush cycles can be performed without emptying all of the air from the chamber 63*a* before the macerator pump 26 shuts off. When the pump turns off, the valve 77 and the one way valve 76 close, trapping compressed air between them and the evacuation valves 13 and 14. Water in the air/water chamber 63 drains back into the pump 26 and the holding tank 23 as fresh air is inducted into the chamber 63*a* through an air induction valve 66 through pipe 67 and 64. A float valve 72 is mounted in a valve guide 73 below pipe 71 and prevents water from getting into the solenoid valve 77** in the event the air/- water chamber 63*a* loses all of its air due to leaks. The large rubber ball 69 floats and serves to dampen pressure oscillations and to prevent water splashes from getting past float valve 72. The rubber ball float 69 is mounted in the valve guide 74.

The pressurized air in pipe 78 acts through a 3-way solenoid valve 41 (or 42) on the outside of the sleeve of a squeeze type evacuation valve to keep it closed. When the control is activated to open the evacuation valve, the solenoid valve 41 (or 42) shuts off the compressed air port and releases air from the outside of the sleeve in the squeeze valve to the pipe 48 (or 49).

The solenoid valve 77 has a control which is connected to control 39 to open and close it.

The unit is unlikely to clog and is very reliable and there are no strainers or components that are likely to stick such as pistons at the air/water interface in the chamber.

Although the invention has been described with respect to preferred embodiments, it is not to be so limited as changes and modifications may be made therein which are within the full intended scope as defined by the appended claims.

We claim as our invention:

1. A toilet system for a mobile unit comprising at least one toilet bowl mounted on the unit, a bowl discharge pipe connected to said bowl, an evacuation valve mounted in said bowl discharge pipe, a transfer manifold pipe to which said bowl discharge pipe is connected, a non-clogging jet pump connected to said transfer manifold, a tank connected to said non-clogging jet pump, a macerator pump with an input port connected to said tank and an output port connected to said non-clogging jet pump, an air induction valve mounted in said manifold pipe, and a toilet flush valve;

wherein said non-clogging jet pump comprises a first inlet passage, a second inlet passage and an outlet passage connected to said first and second inlet passages and a reduced cross-sectional portion between said first inlet passage and said outlet passage to form a venturi so as to apply suction to said second inlet passage when fluid flows between said first inlet passage and said outlet passage, wherein said inlet port of said macerator pump is connected to a lower portion of said tank, wherein said outlet passage of said non-clogging jet pump is connected to an upper portion of said tank;

means for controlling said toilet system including a flush control to energize a flushing of the toilet system, a means for controlling said toilet flush valve, a means for controlling said evacuation valve, a pressure sensor mounted on the output port side of the macerator pump for sensing the discharge pressure of the macerator pump, and means for controlling said air induction valve after flushing has occurred to allow high speed air to be drawn through said transfer manifold pipe.

2. A toilet system according to claim 1 wherein said macerator pump is capable of reversing to clean itself when performance drops due to excessive solids build up in its casing.

3. A toilet system for a mobile unit comprising at least one toilet bowl mounted on the unit, a bowl discharge pipe; connected to said bowl, an evacuation valve and control mounted in said bowl discharge pipe, a transfer manifold pipe to which said bowl discharge pipe is connected, a non-clogging jet pump connected to said transfer manifold, a tank connected to said non-clogging jet pump, a macerator pump with an input port connected to said tank and an output port connected to said non-clogging jet pump, an air induction valve and control mounted in said manifold line, and means for controlling connected to said macerator pump and to the controls of said evacuation valve, and a flush control connected to said means for controlling to energize the toilet system, and wherein said control for said evacuation valve comprises a compressed air inlet tube, a three way solenoid valve, a hydraulic air compressor with an inlet port connected to the outlet port of said macerator pump and having an air-liquid chamber, and a valve and control connected between said air-liquid chamber and said pressure control pipe and said means for controlling connected to said valve control.

4. A toilet system according to claim 3 including a one way valve connected between said valve and said air-liquid chamber.

5. A toilet system according to claim 4 including a float valve connected between said air-liquid chamber and said valve.

6. A toilet system according to claim 5 including a one way air inlet valve connected to said air-liquid chamber.

* * * * *